US012660936B2

(12) United States Patent
Leng

(10) Patent No.: US 12,660,936 B2
(45) Date of Patent: Jun. 23, 2026

(54) STRUCTURE OF SPRING MODULE GROUP FOR INSTALLING INDEPENDENT SPRINGS, SPRING MATTRESS, AND CUSHION

(71) Applicant: Luhao Leng, Xiamen City (CN)

(72) Inventor: Luhao Leng, Xiamen City (CN)

( * ) Notice: Subject to any disclaimer, the term of this patent is extended or adjusted under 35 U.S.C. 154(b) by 0 days.

(21) Appl. No.: 18/917,310

(22) Filed: Oct. 16, 2024

(65) Prior Publication Data

US 2025/0176733 A1 Jun. 5, 2025

(30) Foreign Application Priority Data

Dec. 5, 2023 (CN) ..... 202311670174.4

(51) Int. Cl.
*A47C 27/07* (2006.01)
*A47C 27/06* (2006.01)

(52) U.S. Cl.
CPC ..... *A47C 27/07* (2013.01); *A47C 27/063* (2013.01)

(58) Field of Classification Search
CPC ..... A47C 27/00; A47C 27/04; A47C 27/07; A47C 27/063; A47C 27/0456; A47C 23/002
See application file for complete search history.

(56) References Cited

U.S. PATENT DOCUMENTS 6,113,082 A * 9/2000 Fujino ..... F16F 1/025 267/110
11,019,937 B2 * 6/2021 Leng ..... A47C 27/20
2018/0325273 A1 * 11/2018 Cailley ..... A47C 23/067
2023/0200553 A1 * 6/2023 Leng ..... A47C 27/064 5/720
2025/0194817 A1 * 6/2025 Leng ..... A47C 23/002

FOREIGN PATENT DOCUMENTS

CN 204105423 U 1/2015
CN 112674540 A 4/2021
CN 215382719 U 1/2022
CN 215686204 A 2/2022
CN 218127784 U 12/2022
CN 115590332 A 1/2023
CN 115998114 A 4/2023
(Continued)

OTHER PUBLICATIONS

International Search Report cited in PCT/CN2024/136767, mailed Feb. 5, 2025, 8 pages.
(Continued)

*Primary Examiner* — Fredrick C Conley
(74) *Attorney, Agent, or Firm* — COOPER LEGAL GROUP LLC

(57) ABSTRACT

A structure of a spring module group for installing independent springs, the spring module group is configured to be assembled to form a spring mattress, the spring module group includes a connecting base and a plurality of elastic modules assembled on the connecting base, the connecting base includes a plurality of through holes corresponding to the plurality of elastic modules, the connecting base includes one or more buckling grooves configured to limit the plurality of elastic modules from being separated from the connecting base, and the one or more buckling grooves are configured to be releasably buckled to the plurality of elastic modules.

14 Claims, 13 Drawing Sheets

(56) References Cited

FOREIGN PATENT DOCUMENTS

| | | | |
|---|---|---|---|
| CN | 116250695 | A | 6/2023 |
| DE | 20209100 | U1 | 7/2003 |
| JP | H06277134 | A | 10/1994 |
| WO | 2017206961 | A1 | 12/2017 |

OTHER PUBLICATIONS

Written Opinion cited in PCT/CN2024/136767, mailed Feb. 5, 2025, 7 pages.
EP Office Action cited in EP24217275.7, mailed May 7, 2025, 4 pages.
EP Search Report cited in EP24217275.7, mailed Mar. 26, 2025, 2 pages.
Notification of Grant cited in EP24217275.7, mailed Nov. 14, 2025, 7 pages.

* cited by examiner

STRUCTURE OF SPRING MODULE GROUP FOR INSTALLING INDEPENDENT SPRINGS, SPRING MATTRESS, AND CUSHION

RELATED APPLICATIONS

This application claims priority to Chinese patent application 202311670174.4, filed on Dec. 5, 2023. Chinese patent application 202311670174.4 is incorporated herein by reference.

FIELD OF THE DISCLOSURE

The present disclosure relates to the technical field of furniture, such as a spring mattress, and in particular relates to a structure of a spring module group for installing independent springs, a spring mattress, and a cushion.

BACKGROUND OF THE DISCLOSURE

Large furniture, such as soft cushions and bed mattresses formed from elastic mattresses are essential components of daily life. Currently, most of the elastic mattresses are difficult to disassemble or difficult to be restored once disassembled. However, with development of modern life, the large furniture, such as the elastic mattresses, needs to be disassembled and assembled with increasing frequencies to fulfill requirements of population mobility and outdoor leisure. During a transportation process, people sometimes discard the elastic mattresses while still being usable to reduce relocation burden due to the disassembly and assembly of beds being very difficult.

The existing elastic mattresses are typically an integrated, non-detachable, and closed single-piece mattress made of a single-piece base layer, a spring layer, a sponge overlay layer, and an enclosed sidewall. That is, the spring layer is disposed on the single-piece base layer, the sponge overlay layer is disposed on the spring layer, and the enclosed sidewall is connected to and disposed between the sponge overlay layer and the single-piece base layer to form an enclosed space.

In pursuit of detachability, mobility, and re-assembly, spring mattresses with modular units commonly in the market are assembled into large mattresses within a compact space. However, the spring mattresses are still single-piece products that cannot be disassembled, are difficult to transport, and take up a large space for storage. Additionally, the spring mattresses have a high cost with lower stability during actual use, thereby reducing comfort.

BRIEF SUMMARY OF THE DISCLOSURE

The technical problem to be solved by the present disclosure is to provide a structure of a spring module group for installing independent springs, a spring mattress, and a cushion. The structure is simple, easy to disassemble and assemble, and disassembled elastic modules can be stacked and sleeved together, thereby greatly saving storage and transportation spaces.

In order to solve the above technical problems, the present disclosure provides the structure of the spring module group for installing the independent springs, the spring mattress, and the cushion as follows.

A structure of a spring module group for installing independent springs, the spring module group is configured to be assembled to form a spring mattress, the spring module group comprises a connecting base and a plurality of elastic modules assembled on the connecting base, the connecting base comprises a plurality of through holes corresponding to the plurality of elastic modules, the connecting base comprises one or more buckling grooves configured to limit the plurality of elastic modules from being separated from the connecting base, and the one or more buckling grooves are configured to be releasably buckled to the plurality of elastic modules.

In a preferred embodiment, the one or more buckling grooves are configured to be slidably connected to the plurality of elastic modules, the one or more buckling grooves are configured to limit the plurality of elastic modules from being separated from the connecting base in a vertical direction, one end of the connecting base comprises a sliding inlet for the plurality of elastic modules, the connecting base is disposed with a positioning structure corresponding to a location of a first elastic module of the plurality of elastic modules and adjacent to the sliding inlet, and the positioning structure is configured to limit the plurality of elastic modules from sliding out of the sliding inlet.

In a preferred embodiment, the one or more buckling grooves comprises C-shaped buckling grooves, the C-shaped buckling grooves are disposed on two side edges of the connecting base, groove openings of the C-shaped buckling grooves are opposite to each other, and edges of spring fixing seats of the plurality of elastic modules are buckled to the C-shaped buckling grooves to position the plurality of elastic modules.

In a preferred embodiment, a body of the connecting base is inclined to form protruding portions as the positioning structure, the positioning structure is higher than a sliding surface of the connecting base, and fixing seat bodies of spring fixing seats of the plurality of elastic modules are formed with concave portions configured for receiving the protruding portions.

In a preferred embodiment, the protruding portions are configured as elastic sheets with slopes so as to be releasably buckled to the concave portions to position the plurality of elastic modules, and a side of the elastic sheets facing away from the sliding surface of the connecting base comprises pressing portions for pushing the positioning structure out of the concave portions to release the positioning of the plurality of elastic modules.

In a preferred embodiment, the connecting base comprises a first base and a second base, and first sides of first ends of the first base and the second base form a pivoted connection.

In a preferred embodiment, second sides opposite to the pivoted connection on the first ends of the first base and the second base are disposed with first buckling members opposite to each other and configured to be buckled together, side edges of the first base and the second base forming a spliced connection through rotation and side edges of the first base and the second base separated from each other through the rotation are disposed with second buckling members opposite to each other and configured to be connected together, the connecting base is configured using the pivoted connection such that the first base and the second base are configured to be releasably engaged with each other through the second buckling members on the side edges of the first base and the second base for the spliced connection, or the connecting base is configured using the pivoted connection such that the first base and the second base are configured to be releasably buckled through the first buckling members on the first ends of the first base and the second base, and the connecting base is configured to be releasably engaged with a second connecting base adjacent to the connecting base through the second buckling members.

In a preferred embodiment, sliding inlets for the plurality of elastic modules are disposed on the first ends of the first base and of the second base having the pivoted connection.

In a preferred embodiment, the plurality of elastic modules comprise spring fixing seats and spring sleeves buckled to each other, the spring sleeves are configured to receive tapered springs in the spring sleeves, the spring sleeves have cavities configured for a first spring sleeve of the spring sleeves to be stack with a second spring sleeve of the spring sleeves, and the spring fixing seats comprise openings corresponding to the cavities to allow the second spring sleeve of the spring sleeves to be stacked on the first spring sleeve of the spring sleeves.

In a preferred embodiment, the plurality of through holes of the connecting base correspond to the openings of the spring fixing seats to enable the spring module group and one or more other spring module groups to be stacked.

In a preferred embodiment, the spring sleeves in the plurality of elastic modules for receiving the tapered springs are plastic spring sleeves or cloth-wrapped spring sleeves.

A spring mattress, the spring mattress is formed using the structure of the spring module group for installing the independent springs, two sides of an end of the spring module group are oppositely disposed with a rotating buckling member and an engaging member configured to be buckled to each other, and the rotating buckling member of the spring module group is configured to be releasably connected to an engaging member of a second spring module group.

A cushion, which comprises the spring mattress, a flexible cushion layer, and a cloth cover, the flexible cushion layer and the cloth cover are disposed on the spring mattress in sequence, the flexible cushion layer comprises a skirt having hanging straps, and the rotating buckling member comprises a hanging lug configured to cooperate with and hang to a corresponding one of the hanging straps to fix the flexible cushion layer.

Compared with the existing techniques, the technical solution of the present disclosure has the following advantages.

1. The spring module group provided by the present disclosure is assembled by independent elastic modules so as to disassemble and assemble easily. Both the independent elastic modules and the spring module group after assembly can be stacked in multiples, thereby greatly saving storage and transportation spaces.
2. The spring module group provided by the present disclosure comprises a rotatable connecting base that forms a folded storage structure or an unfolded splicing structure. The connecting base can be deformed to disassemble for storage, thereby effectively reducing an occupied space of the spring module group during storage and transportation.
3. The spring module group provided by the present disclosure can be freely spliced and combined to form a spring mattress with different specifications and sizes so as to significantly improve a convenience for assembling the spring mattress and to be easily disassembled for storage.

Figure 1:
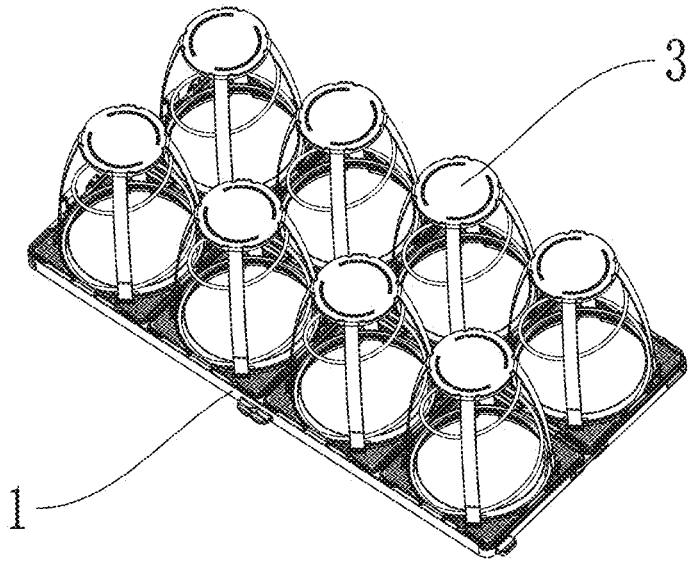
FIG. 1 is a perspective view of a spring module group in a folded state for storage in a preferred embodiment of the present disclosure.

Reference numerals: 1—connecting base; 11—through hole; 12—first base; 13—second base; 14—pivoted connection; 15—buckling groove; 16—sliding inlet; 17—protruding portion; 171—pressing portion; 18—first buckling member; 19—second buckling member; 2—elastic module; 21—spring fixing seat; 221—concave portion; 22—spring sleeve; 23—tapered spring; 3—spring module group; 31—rotating buckling member; 311—hanging lug; 32—engaging member; 4—spring mattress; 5—flexible cushion layer; 51—hanging strap; 6—cloth cover; 7—soft cushion;

170—positioning structure; 312—hanging hook; 321—receiving groove; 322—buckling column.

DETAILED DESCRIPTION OF THE EMBODIMENTS

The technical solutions in the embodiments of the present disclosure will be will clearly and completely described below with reference to the accompanying drawings in the embodiments of the present disclosure. It is obvious that the described embodiments are merely some embodiments of the present disclosure instead of all embodiments. All other embodiments fall within the protection scope of the present disclosure provided that they are obtained based on the embodiments of the present disclosure by those of ordinary skill in the art without creative works.

In the description of the present disclosure, it should be noted that the terms "upper", "lower", "inner", "outer", "top", "bottom", etc. indicate orientations or positional relationships based on the orientations or the positional relationships shown in the drawings, so as to merely easily describe the present disclosure and simplify the description, rather than indicating or implying that the referenced device or element should have a specific orientation and be constructed and operated in the specific orientation, and the orientations or the positional relationships should not be understood as a limitation of the present disclosure. In addition, the terms "first" and "second" are merely used for description and should not be understood to indicate or imply relative importance.

In the description of the present disclosure, unless otherwise specified and limited, it should be noted that the terms, such as "installed", "disposed", "sleeved", "socketed", and "connected" should develop broad understanding, for example, "connected" can be a wall-mounted connection, a detachable connection, an integrated connection, a mechanical connection, an electrical connection, a direct connection, an indirect connection through an intermediator, or communication between inner portions of two members, and specific meaning of the terms in the present disclosure can be understood under specific conditions for those of ordinary technical skill in the art.

Referring to FIGS. 1-24, this embodiment provides a structure of a spring module group 3 for installing independent springs, and the spring module group 3 is configured to be sequentially assembled in multiples to form an elastic mattress 4 (i.e., a spring mattress 4). The spring module group 3 comprises a connecting base 1 and a plurality of elastic modules 2 assembled on the connecting base 1.

The connecting base 1 comprises a first base 12 and a second base 13, and sides of the first base 12 and the second base 13 on ends thereof achieve a pivoted connection 14. The first base 12 and the second base 13 form movements of relative folding or relative unfolding through the pivoted connection 14. When being folded, a long side of the connecting base 1 is folded in half to reduce an occupied space of the long side of the connecting base 1. When being stored, a storage space of the connecting base 1 after being folded is small to be easily stored. Additionally, a length of the connecting base 1 is reduced to avoid partial breakage phenomenon during transportation due to excessive length.

To better maintain a state of relative folding or relative unfolding of the connecting base 1, sides of the first base 12 and the second base 13 on the ends having the pivoted connection 14 opposite to the pivoted connection 14 are disposed with first buckling members 18 opposite to each other and configured for a buckled connection. Additionally, at the same time, side edges configured to form a spliced connection by rotation of the first base 12 and the second base 13 or side edges configured to be separated from each other by the rotation are disposed with second buckling members 19 opposite to each other and configured to be connected together.

A specific operation is that the connecting base 1 is configured using the pivoted connection 14 such that the first base 12 and the second base 13 have releasable engagement using the second buckling members 19 on the side edges for the spliced connection. Alternatively, the connecting base 1 is configured using the pivoted connection 14 such that the first base 12 and the second base 13 have releasable buckled engagement using the first buckling members 18 on the ends having the pivoted connection 14. At this time, the connecting base 1 is configured to have releasable engagement with another connecting base 1 adjacent to the connecting base 1 through the second buckling members 19.

Figure 2:
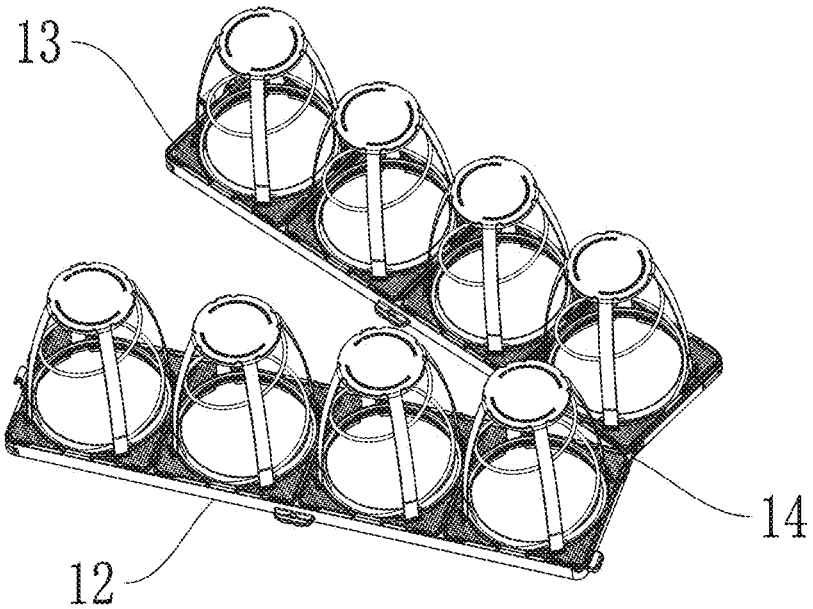
FIG. 2 is a perspective view of the spring module group in an unfolding process in the preferred embodiment of the present disclosure.
Figure 3:
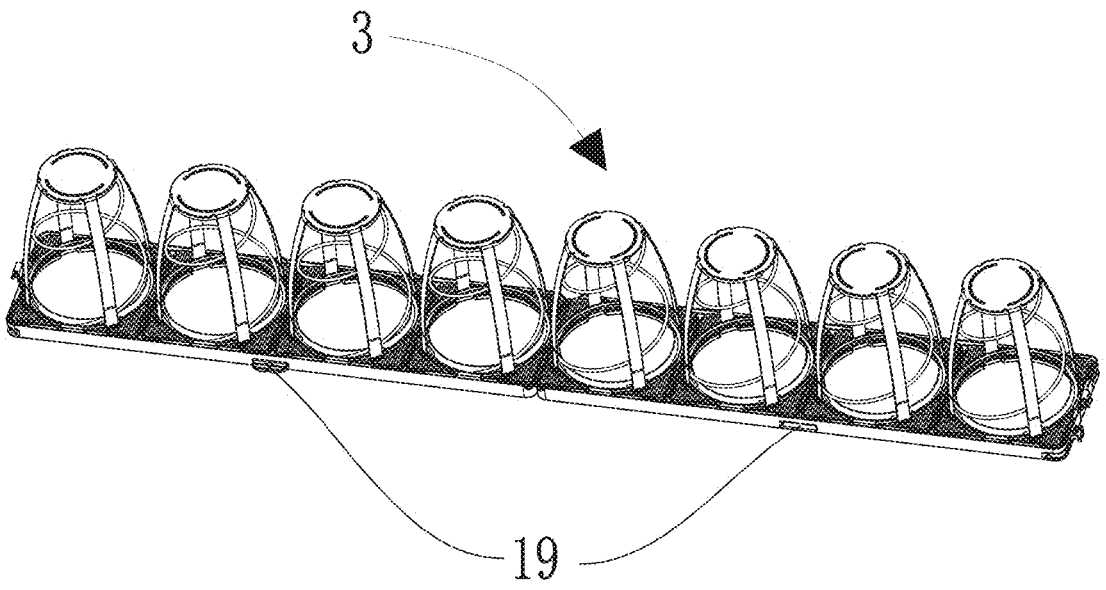
FIG. 3 is a perspective view of the spring module group in a fully unfolded state in the preferred embodiment of the present disclosure.
Figure 4:
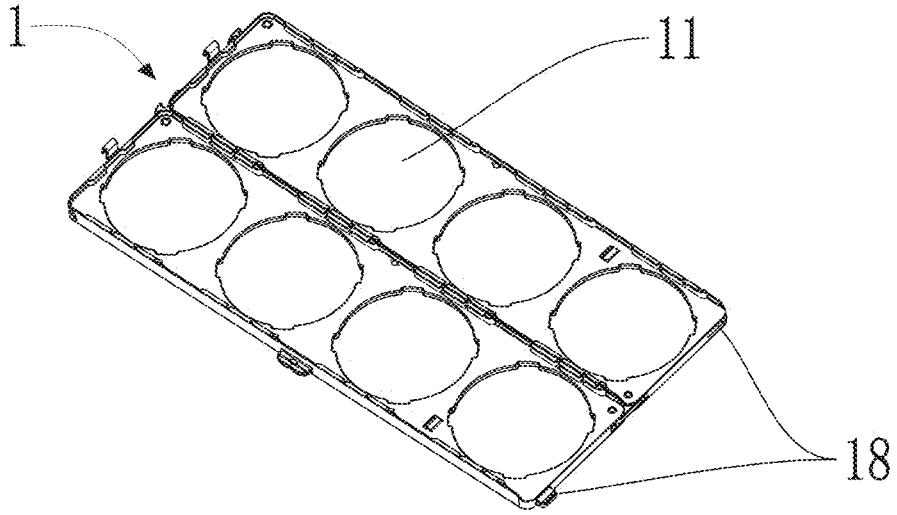
FIG. 4 is a structural perspective view of a connecting base in the preferred embodiment of the present disclosure.
Figure 5:
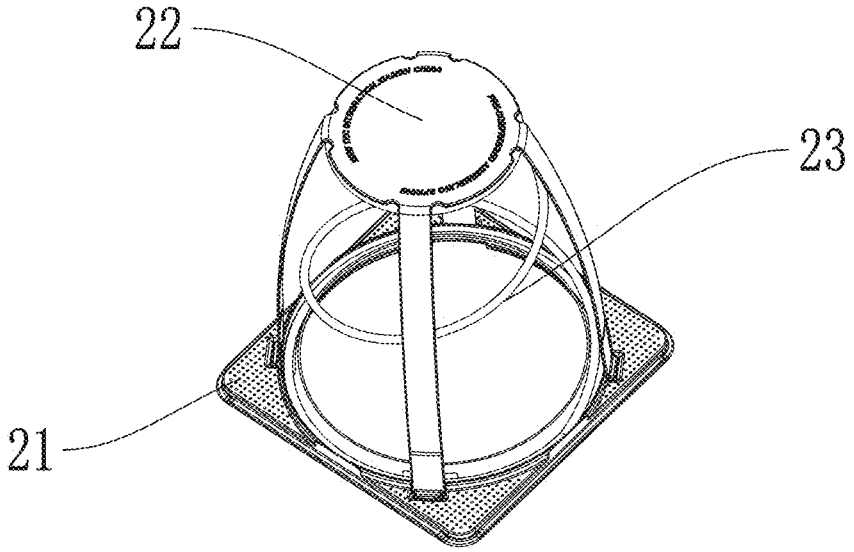
FIG. 5 is a structural perspective view of an elastic module in the preferred embodiment of the present disclosure.

As shown in FIGS. 1-3, an unfolding process of the spring module group 3 shown in FIG. 2 is mainly used. When the connecting base 1 assembled with the plurality of elastic modules 2 rotates around the pivoted connection 14 using the first base 12 and the second base 13. Using a long side of the first base 12 or the second base 13 as a standard, a long side of a first one of the first base 12 or the second base 13 rotates to abut a long side of a second one of the first base 12 or the second base 13. At this time, the second buckling members 19 on the side edges of the first base 12 and the second base 13 for the spliced connection that abut each other are connected together, and the connecting base 1 is folded for storage at this time. When the connecting base 1 assembled with the plurality of elastic modules 2 rotates around the pivoted connection 14 using the first base 12 and the second base 13, a short side (i.e., the short side on which the ends for the rotation is located) of the first base 12 or the second base 13 is used as a standard. A first one of the short sides of the first base 12 or the second base 13 rotates to abut a second one of the short sides of the first base 12 or the second base 13. At this time, the first buckling members 18 on the short sides of the first base 12 and the second base 13 that abut each other are connected together, and the connecting base 1 is completely unfolded at this time. When the connecting base 1 is in an unfolded state, a function of the second buckling members 19 is converted into a spliced and buckled function in the spring mattress 4, and one of the second buckling members 19 on one of the connecting bases 1 is engaged with a corresponding one of the second buckling members 19 on another one of the connecting bases 1 to realize a spliced connection.

In this embodiment, a folding and unfolding structure of the spring module group 3 further comprises a locking structure, and the locking structure comprises a rotating buckling member 31 and an engaging member 32 configured to be buckled together and disposed on two sides of an end of the spring module group 3. The rotating buckling member 31 is configured to swing back and forth around a pivoted axis to be releasably engaged with the engaging member 32 opposite to the rotating buckling member 31, and the engaging member 32 is configured to be releasably engaged with the rotating buckling member 31 opposite to the engaging member 32. Specifically, the locking structure is disposed on ends of the first base 12 and the second base 13 opposite to the pivoted connection 14. One side of two sides of a respective end of the first base 12 and the second base 13 is disposed with the rotating buckling member 31 with another side of two sides of a respective end of the first base 12 and the second base 13 being disposed with the engaging member 32. A position relationship is as follows, when the first base 12 and the second base 13 are relatively folded, the rotating buckling member 31 on one base of the first base 12 or the second base 13 can be relatively engaged with the engaging member 32 on the other base of the first base 12 or the second base 13 to form a locking connection.

When the connecting base 1 is folded for storage, the locking structure is configured to enable the first base 12 and the second base 13 to be locked after the first base 12 and the second base 13 are relatively folded. Additionally, when the connecting base 1 is unfolded for multiple splicing, the locking structure is configured to enable the connecting bases 1 to be locked pairwise. In an arrangement of the locking structure, the first buckling members 18 and the second buckling members 19 are provided for pre-positioning.

It should be noted that the first buckling members 18 and the second buckling members 19 can be of various types, and as long as the adjacent bases (e.g., the first base 12 and the second base 13, or the adjacent two of the connecting bases 1) can be pre-positioned, it does not matter what type of pre-positioning structure is adopted. In this embodiment, the first buckling members 18 comprise two pre-positioning structures with different structures, and the second buckling members 19 comprise two pre-positioning structures with different structures. Specifically, one of the first buckling members 18 or one of the second buckling members 19 is an extendable elastic protrusion, with the other one being a concave part configured to receive the extendable elastic protrusion. The extendable elastic protrusion is connected to the concave part after aligning in a lateral direction, a balance of pre-positioning of the adjacent bases can be further improved. Alternatively, the first buckling members 18 or the second buckling members 19 can adopt a buckling hook and a buckling groove configured to be connected together.

The connecting base 1 assembled with the plurality of elastic modules 2 mentioned in this embodiment, as shown in FIGS. 4-12, has an assembly structure as follows.

The first base 12 and the second base 13 comprise buckling grooves 15 configured to be slidably connected to the plurality of elastic modules 2. The buckling grooves 15 limit the plurality of elastic modules 2 from being separated from the connecting base 1 in a vertical direction. First ends of the first base 12 and the second base 13 comprise sliding inlets 16 for the plurality of elastic modules 2, and positioning structures 170 are disposed adjacent to the sliding inlets 16 and corresponding to a location of first elastic modules 2 of the plurality of elastic modules 2. The positioning structures 170 are used to limit the plurality of elastic modules 2 from sliding out of the sliding inlets 16.

An assembly sequence is that when the connecting base 1 is in a folded storage state, individuals of the plurality of elastic modules 2 are spliced. The splicing is performed in the folded storage state, and a sliding connection of the plurality of elastic modules 2 and the buckling grooves 15 can be better operated. The long sides of the first base 12 and the second base 13 abut each other to avoid damage to the connecting base 1 due to stress caused by jamming during an assembly process.

Figure 6:
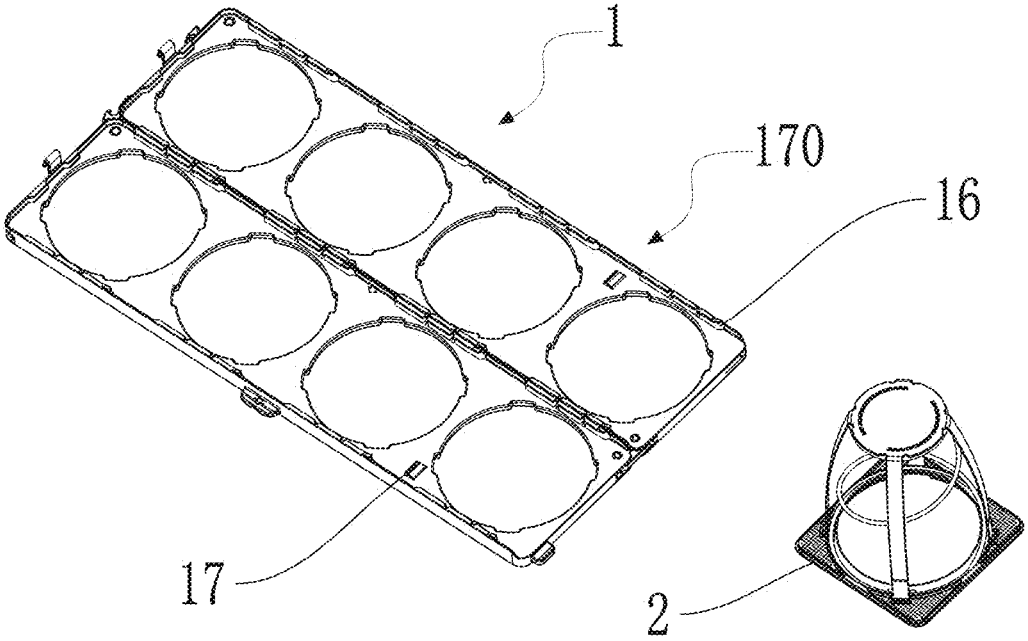
FIG. 6 is a diagrammatic view of an assembly of the connecting base and a single elastic module in the preferred embodiment of the present disclosure.
Figure 7:
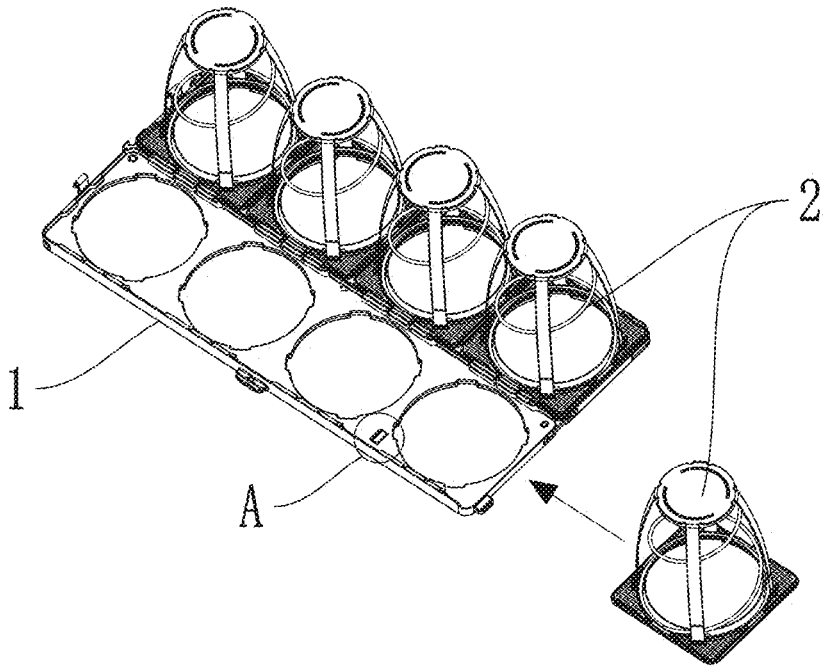
FIG. 7 is a diagrammatic view of an assembly of the connecting base and a plurality of elastic modules in the preferred embodiment of the present disclosure.
Figure 8:
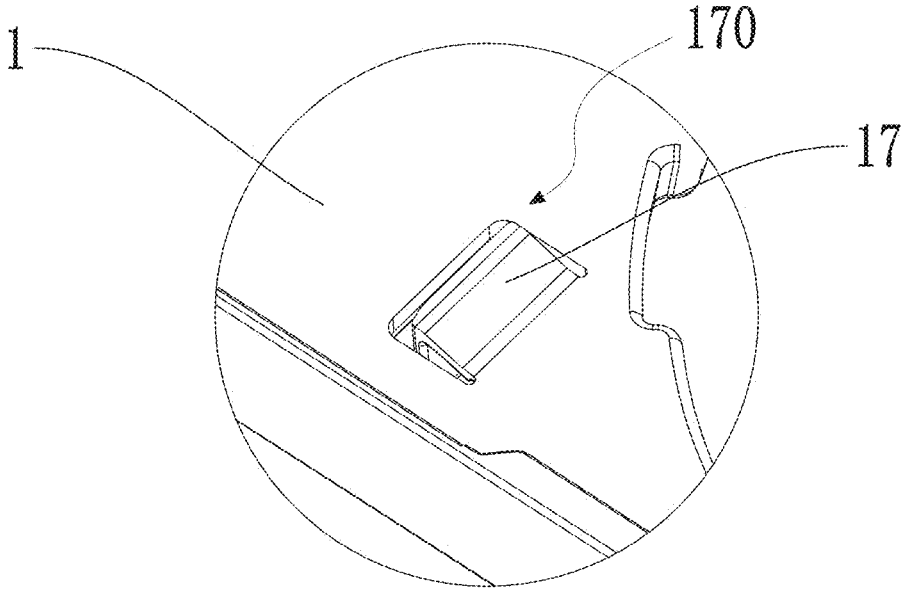
FIG. 8 is an enlarged view of part A in FIG. 7.
Figure 9:
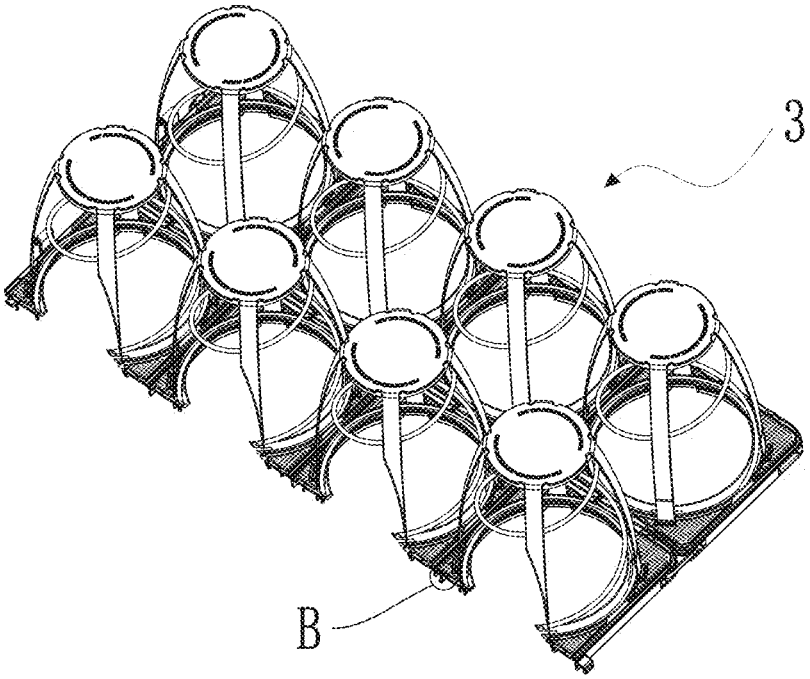
FIG. 9 is a sectional view of a positioning structure of the connecting base and the plurality of elastic modules in the preferred embodiment of the present disclosure.

As shown in FIG. 6, first ends of the first base 12 and the second base 13 disposed with the pivoted connection 14 comprise the sliding inlets 16 with second ends away from the pivoted connection 14 being closed using the buckling grooves 15. In this embodiment, taking four elastic modules 2 of the plurality of elastic modules 2 being assembled to a single-sided base (e.g., the first base 12 or the second base 13) as an example, the four elastic modules 2 are assembled in sequence from a corresponding one of the sliding inlets 16. When a fourth elastic module 2 of the four elastic modules 2 of the plurality of elastic modules 2 is assembled, the fourth elastic module 2 is buckled to a position adjacent to the corresponding one of the sliding inlets 16, and the fourth elastic module 2 is positioned using the positioning structures 170, so that the fourth elastic module 2 is fixed at the corresponding one of the sliding inlets 16 to enable the remaining three elastic modules 2 of the four elastic modules 2 to be positioned by positioning of the fourth elastic module 2.

In this embodiment, the first ends of the first base 12 and the second base 13 disposed with the pivoted connection 14 comprise the sliding inlets 16, so that when the connecting base 1 is unfolded, the sliding inlets 16 are positioned by abutting opposite to each other, thereby further completing positioning of the plurality of elastic modules 2.

Figure 11:
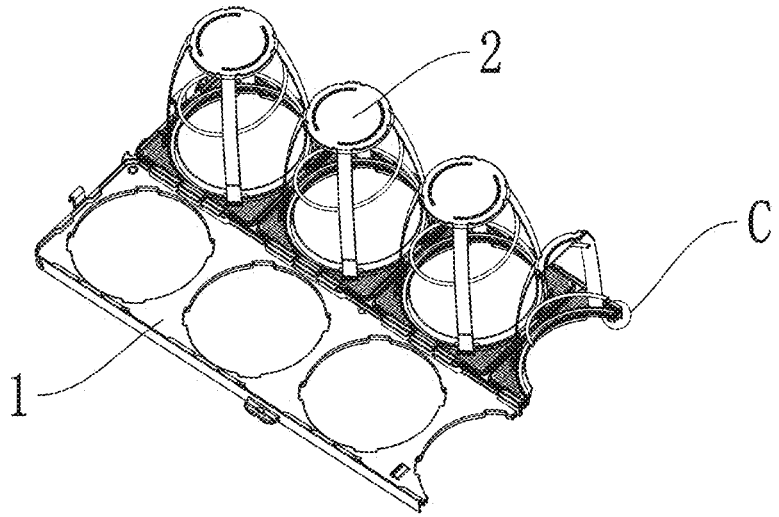
FIG. 11 is a perspective view of a sliding connecting structure of the connecting base and the plurality of elastic modules in the preferred embodiment of the present disclosure.
Figure 12:
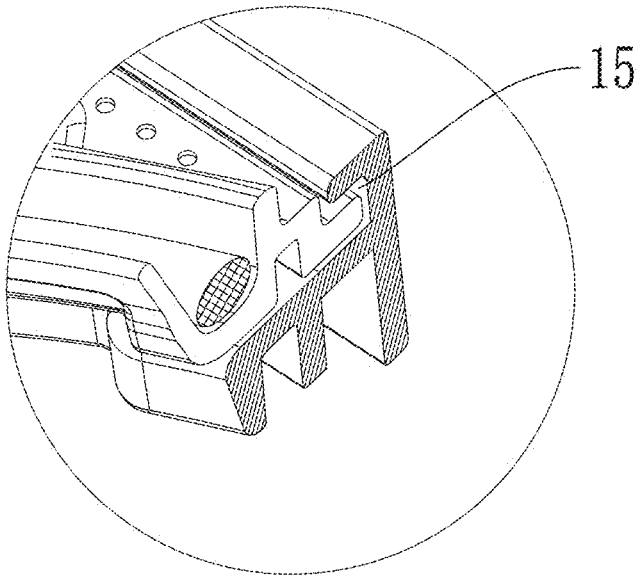
FIG. 12 is an enlarged view of part C in FIG. 11.
Figure 13:
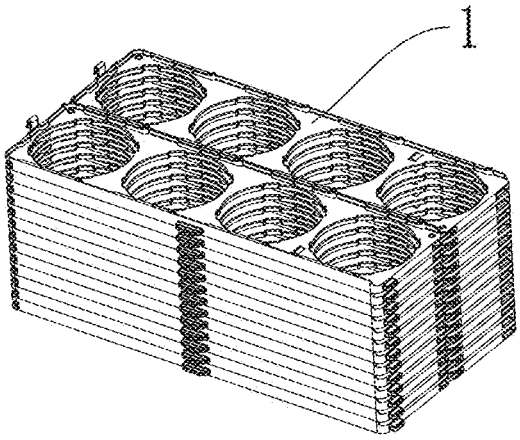
FIG. 13 is a diagrammatic view of stacking of a plurality of connecting bases in the preferred embodiment of the present disclosure.
Figure 14:
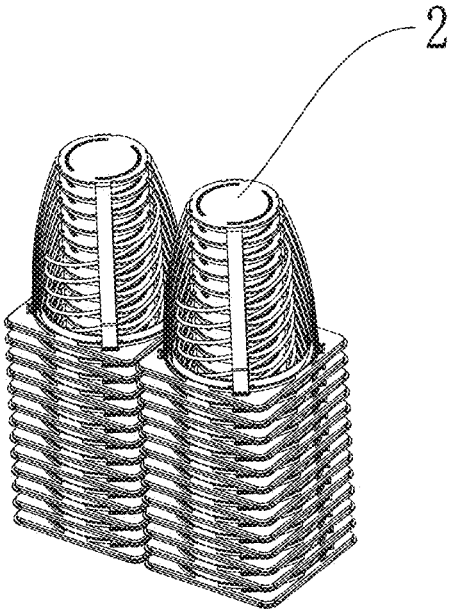
FIG. 14 is a diagrammatic view of stacking of the plurality of elastic modules in the preferred embodiment of the present disclosure.
Figure 15:
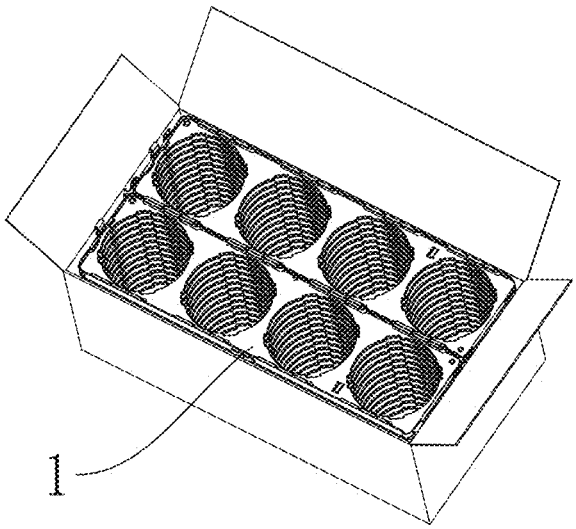
FIG. 15 is a diagrammatic view of the plurality of connecting bases stacked into a box in the preferred embodiment of the present disclosure.
Figure 16:
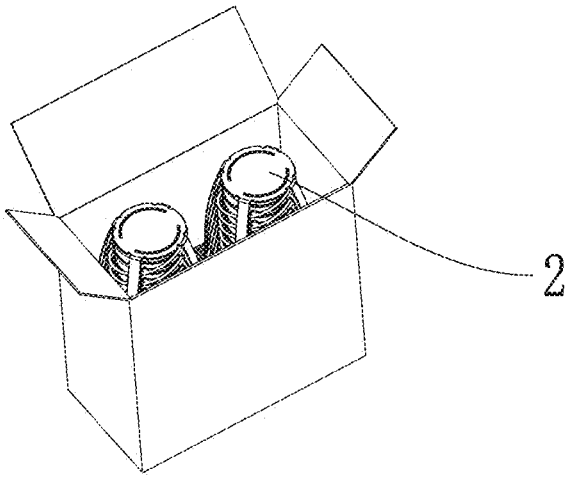
FIG. 16 is a diagrammatic view of the plurality of elastic modules stacked together into a box in the preferred embodiment of the present disclosure.
Figure 17:
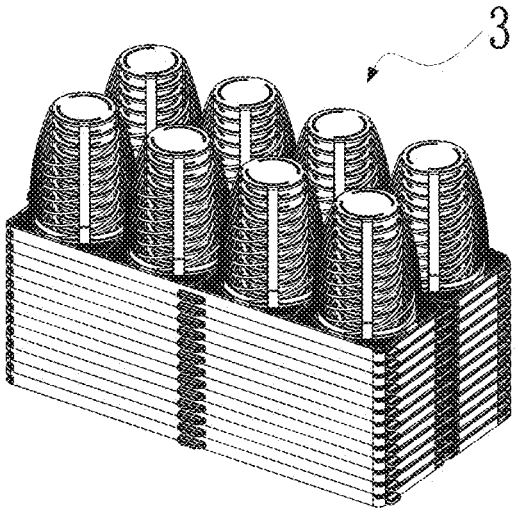
FIG. 17 is a diagrammatic view of stacking of a plurality of spring module groups in the preferred embodiment of the present disclosure.
Figure 18:
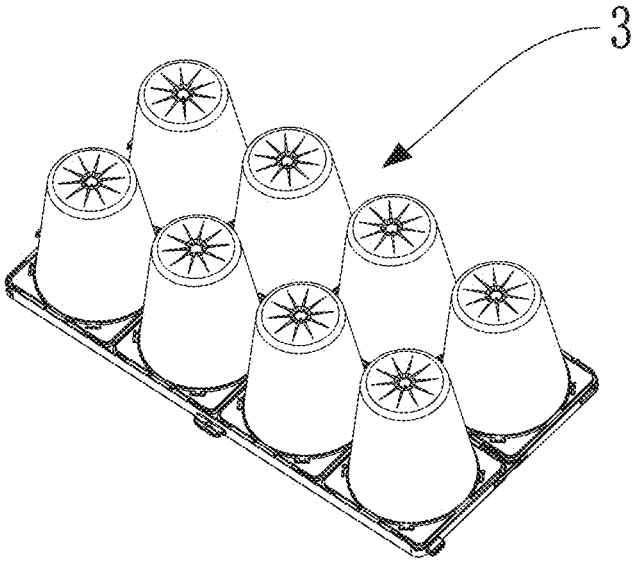
FIG. 18 is a perspective view of a spring module group in a folded state for storage in Embodiment 2 of the present disclosure.

As shown in FIGS. 11-12, a sliding structure between the connecting base 1 and the plurality of elastic modules 2 is that the buckling grooves 15 are C-shaped buckling grooves, and having groove openings opposite to each other are defined on two side edges of each of the first base 12 and the second base 13. Edges of spring fixing seats 21 of the plurality of elastic modules 2 are buckled in the C-shaped buckling grooves 15 to position the plurality of elastic modules 2.

As shown in FIGS. 7-10, the positioning structures 170 are arranged as follows, bodies of the first base 12 or the second base 13 are inclined to form protruding portions 17 as the positioning structures 170, and the positioning structures 170 are higher than sliding surfaces of the first base 12 or the second base 13. Fixing seat bodies of the spring fixing seats 21 of the plurality of elastic modules 2 form concave portions 221 configured for receiving the protruding portions 17.

Furthermore, the protruding portions 17 are configured as elastic sheets with slopes, and inclination angles of the slopes gradually are inclined upward along insertion directions of the plurality of elastic modules 2, so as to be releasably buckled to the concave portions 221 to position the plurality of elastic modules 2. When the plurality of elastic modules 2 are inserted into the buckling grooves 15 along the insertion directions of the plurality of elastic modules 2, the plurality of elastic modules 2 move inward along length directions of the buckling grooves 15 until approaching specified positions. When the plurality of elastic modules 2 move inward from the sliding inlets 16, sliding surfaces of the spring fixing seats 21 of the plurality of elastic modules 2 slide to squeeze the elastic sheets downward for avoidance, thereby ensuring the plurality of elastic modules 2 slide along the insertion directions. However, when the plurality of elastic modules 2 need to slide opposite to the insertion directions, the plurality of elastic modules 2 are positioned due to the elastic sheets being buckled to the concave portions 221. The elastic sheets are just inserted into place when last elastic modules 2 of the plurality of elastic modules 2 are inserted from the sliding inlets 16, and the elastic sheets are just buckled to corresponding concave portions 221 of the last elastic modules 2.

Figure 10:
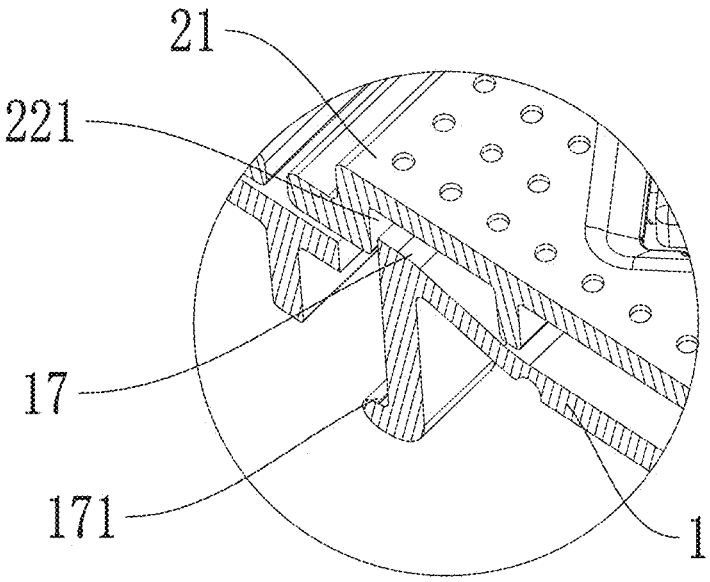
FIG. 10 is an enlarged view of part B in FIG. 9.

A structure for releasing the positioning structures 170 is shown in FIG. 10. A side of the elastic sheets facing away from the sliding surfaces of the first base 12 and the second base 13 comprises pressing portions 171 for pushing the positioning structures 170 out of the concave portions 221 to release the positioning of the last elastic module 2.

In this embodiment, the connecting base 1, the plurality of elastic modules 2, and the spring module group 3 spliced by the connecting base 1 and the plurality of elastic module 2 can be stacked in multiples, as shown in FIGS. 14-17.

The plurality of elastic modules 2 comprise the spring fixing seats 21 and spring sleeves 22 buckled to each other. The spring sleeves 22 are configured to receive tapered springs 23 therein. A first one of the spring sleeves 22 has a cavity for stacking a second one of the spring sleeves 22, and the spring fixing seats 21 comprise openings corresponding to the cavity to allow the second one of the spring sleeves 22 to be stacked.

Due to tapered structures of the tapered spring 23, the tapered springs 23 can be stacked in tapered structures. In this embodiment, diameters of the openings on the spring fixing seats 21 correspond to maximum diameters of the tapered springs 23, inner sides of the spring sleeves 22 comprise tapered cavities corresponding to cavity structures of middle parts of the tapered springs 23, and the spring sleeves 22 are plugged and stacked to one another through the openings.

The connecting base 1 comprises a plurality of through holes 11 corresponding to the plurality of elastic modules 2, and the plurality of through holes 11 of the connection base 1 are matched with the openings of the spring fixing seats 21, so that two or more of the spring module groups 3 can be stacked. The connecting base 1 spliced with the plurality of elastic modules 2 can be stacked in multiples using the plurality of through holes 11 of the connecting base 1.

When the aforementioned stackable overlay structure is disassembled and transported, an occupied space can be reduced by breaking down an entity into parts. In an initial installation state, the connecting base 1 and the plurality of elastic modules 2 can be independently stacked and transported, which is convenient for transportation and sales. Independence of the connecting base 1 and the plurality of elastic modules 2 can realize a replacement of damaged individual parts. When it is necessary to be disassembled and transported again, the spring module group 3 spliced by the connecting base 1 and the plurality of elastic modules 2 can be stacked and transported, so as to realize rapid disassembly and transportation and rapid assembly and use, which is time-saving and labor-saving.

The spring sleeves 22 in the plurality of elastic modules 2 for receiving the tapered springs 23 are plastic spring sleeves 22 or cloth-wrapped spring sleeves 22. FIGS. 1-17 are structural diagrammatic views of the plastic spring sleeves 22, and FIGS. 18-22 are mainly cloth-pocket (i.e., cloth-wrapped) spring sleeves 22.

In Embodiment 2, referring to FIGS. 18-22, the cloth-pocket spring sleeves 22 are used to provide a spring mattress 4 spliced by multiple of the spring module groups 3 described in the aforementioned embodiments.

Figure 19:
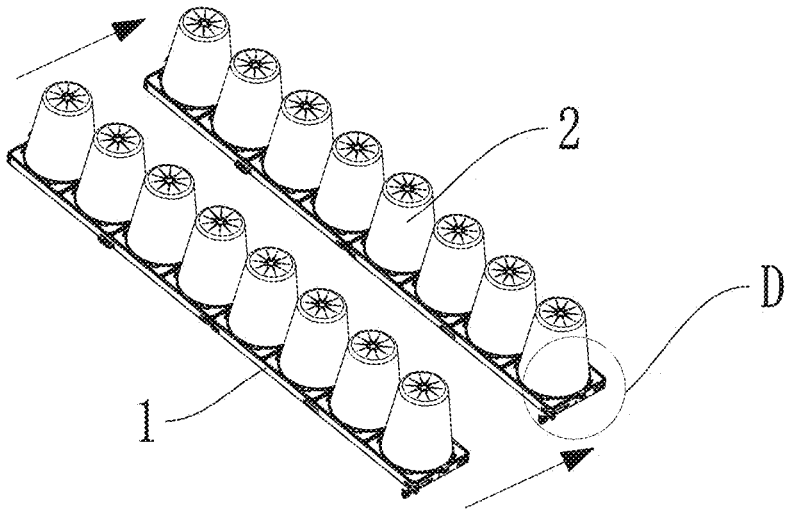
FIG. 19 is a structural diagrammatic view of splicing of two spring module groups in Embodiment 2 of the present disclosure.

In this embodiment, the spring module group 3 spliced using the cloth-pocket spring sleeves 22 is provided. When the spring module group 3 is unfolded, as shown in FIG. 19, the second buckling members 19 of a single side of the connecting base 1 are used as pre-positioning for splicing, so that when the spring module group 3 is assembled to form the spring mattress 4, multiple of the spring module groups 3 are positioned and plugged by connecting the second buckling members 19 corresponding to the connecting bases 1 pairwise, and side edges of the connecting bases 1 for the spliced connection are spliced in sequence. Adjacent two of the connecting bases 1 are locked and connected together through an engagement of the rotating buckling member 31 and the engaging member 32. When the rotating buckling members 31 and the engaging members 32 of all of the connecting bases 1 are completely locked pairwise, the multiple of the spring module groups 3 are assembled to form an elastic supporting layer of the spring mattress 4. A splicing method provided by this embodiment can significantly improve convenience for assembling the spring mattress 4 and facilitate disassembly for storage, and an occupied space of the spring mattress 4 is effectively reduced when the spring mattress 4 is stored.

Figure 20:
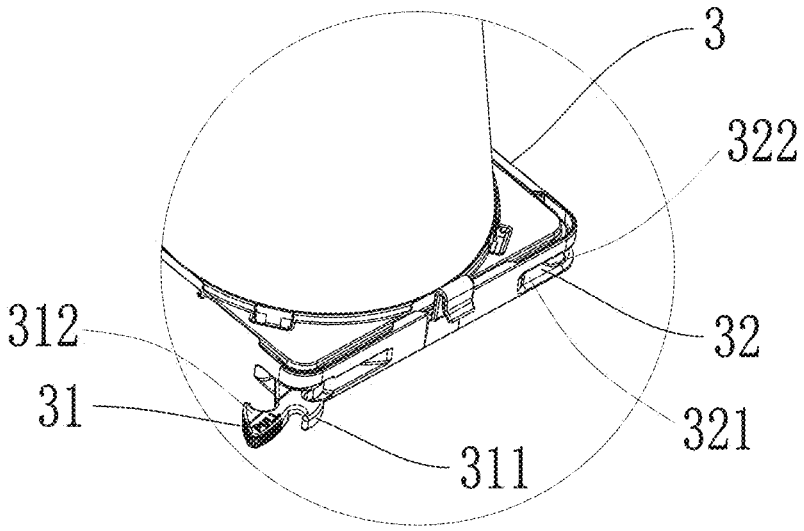
FIG. 20 is an enlarged view of part D in FIG. 19.
Figure 21:
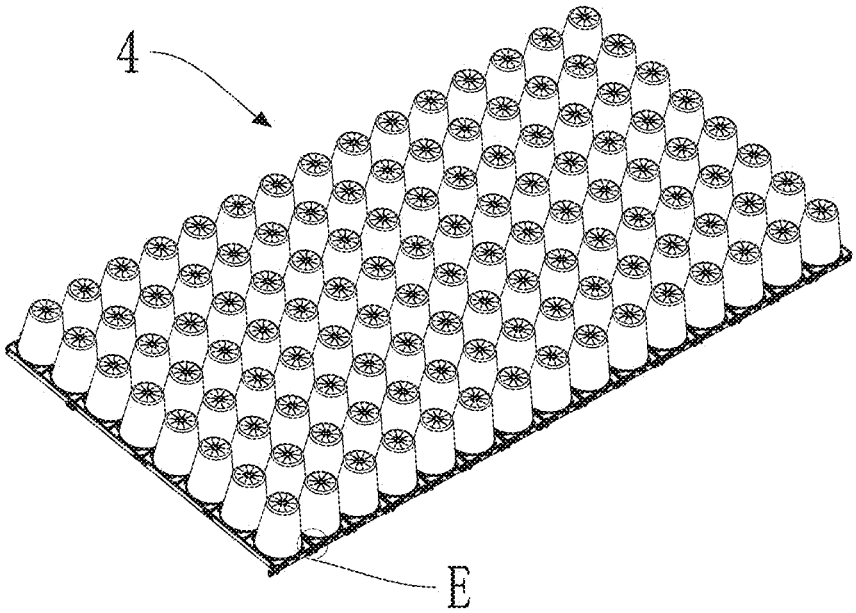
FIG. 21 is a diagrammatic view of a spring mattress spliced by a plurality of spring module groups in Embodiment 2 of the present disclosure.
Figure 22:
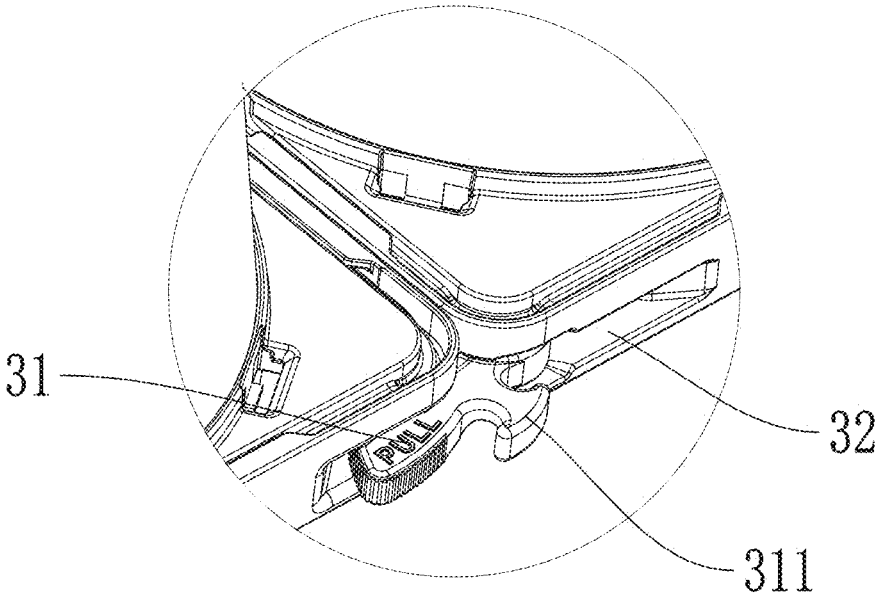
FIG. 22 is an enlarged view of part E in FIG. 21.

As shown in FIG. 20, in this embodiment, the rotating buckling member 31 comprises a hanging lug 311 and a hanging hook 312, and the engaging member 32 comprises a receiving groove 321 and a buckling column 322 disposed in the receiving groove 321. In this way, when the rotating buckling member 31 rotates, the hanging hook 312 is disposed in the receiving groove 321 and is connected to the buckling column 322 to achieve a locking connection. When the rotating buckling member 31 rotates in a reverse direction, the hanging hook 312 is released from the buckling column 322 to achieve unlocking.

Figure 23:
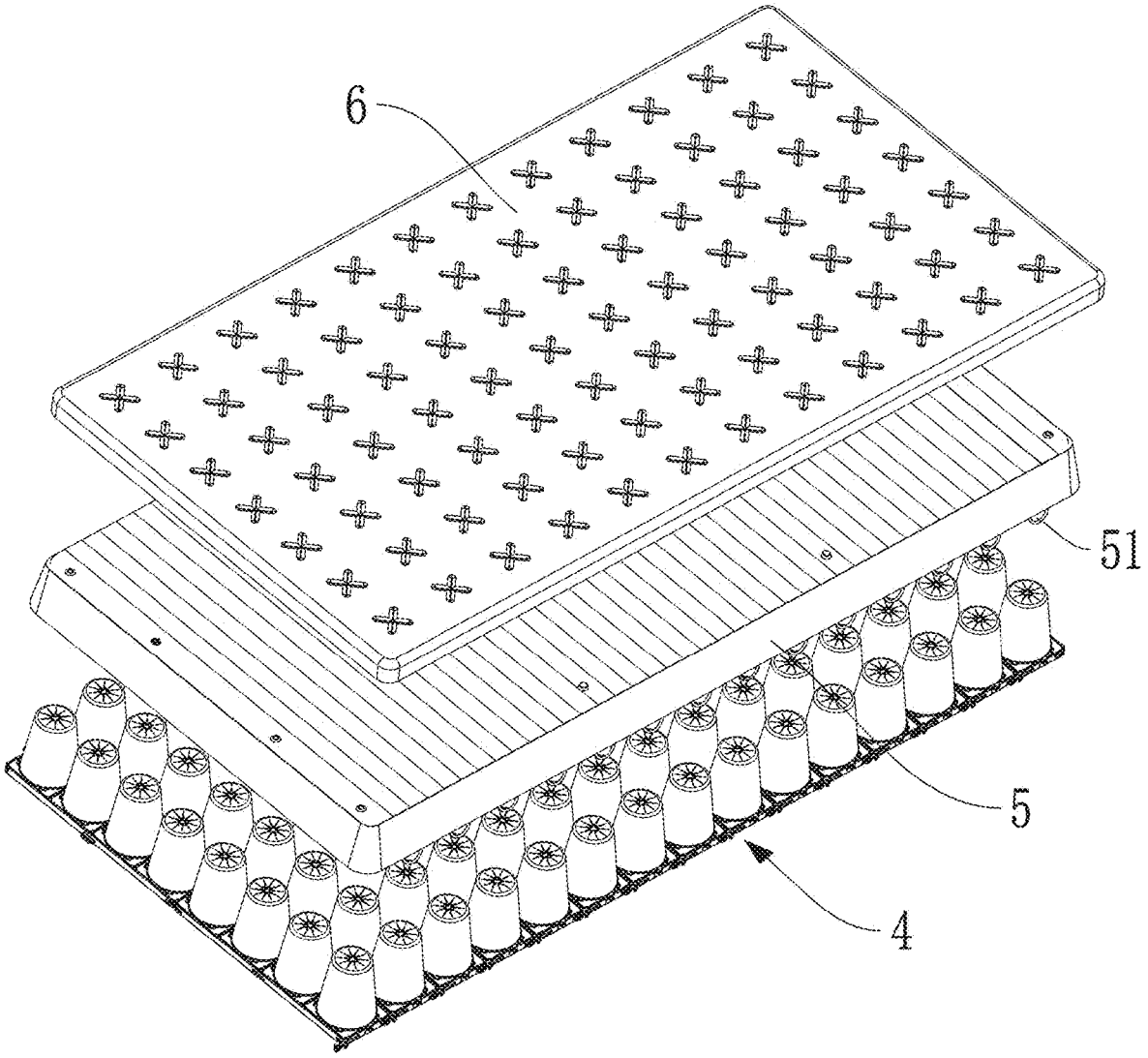
FIG. 23 is a structural exploded view of a soft cushion in Embodiment 3 of the present disclosure.
Figure 24:
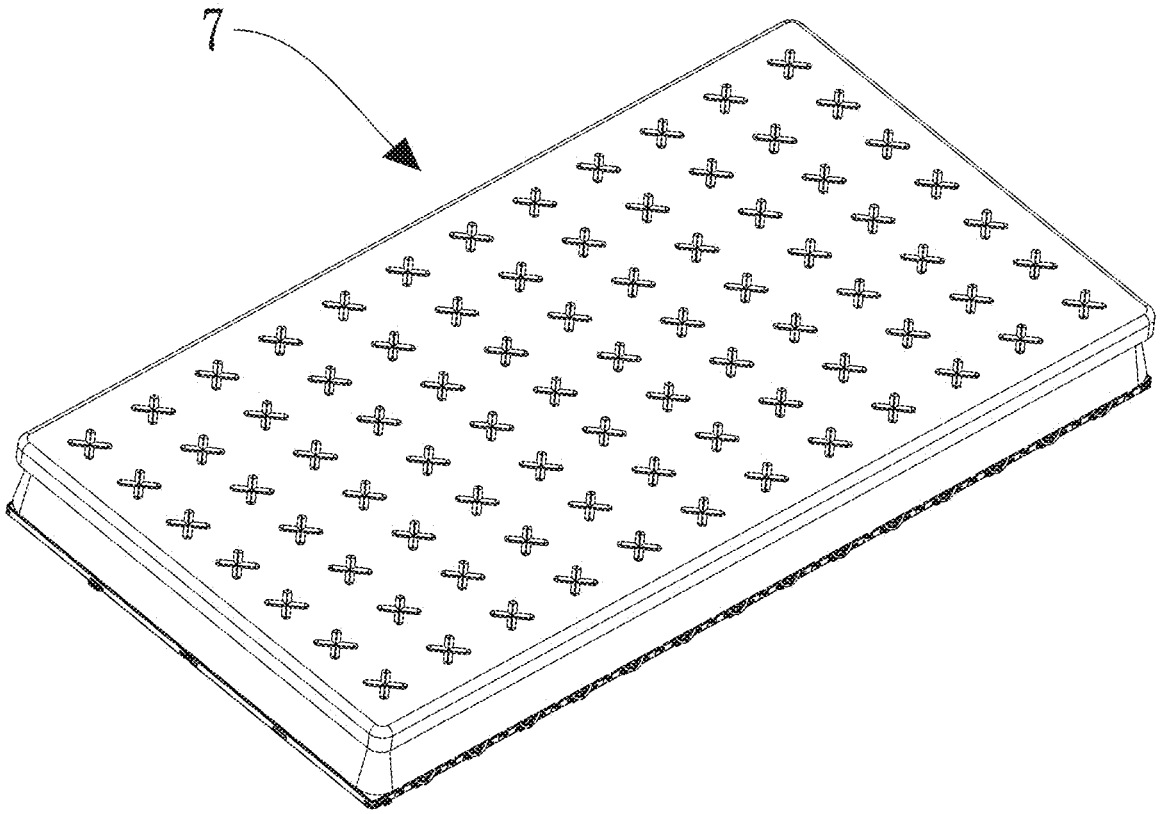
FIG. 24 is a diagrammatic view of an overall structure of the soft cushion in Embodiment 3 of the present disclosure.

In Embodiment 3, referring to FIGS. 23 and 24, based on the spring mattress 4 of Embodiment 2, a soft cushion 7 used as furniture is provided.

The soft cushion 7 comprises the spring mattress 4, a flexible cushion layer 5, and a cloth cover 6. The flexible cushion layer 5 and the cloth cover 6 are laid on the spring mattress 4 in sequence. The flexible cushion layer 5 comprises a skirt having hanging straps 51. The rotating buckling member 31 comprises a hanging lug 311 configured to cooperate with a corresponding one of the hanging straps 51 to fix the flexible cushion layer 5. In this embodiment, the hanging lug 311 can be used to hang the corresponding one of the hanging straps 51 to complete an assembly of the soft cushion 7. Alternatively, the hanging lug 311 is operated by hand to drive the rotating buckling member 31 to rotate to enable the hanging hook 312 be buckled to or separated from the buckling column 322, which is convenient for effective assembly and portable disassembly.

The aforementioned embodiments are merely some embodiments of the present disclosure, and the scope of the disclosure is not limited thereto. Thus, non-substantive modifications of the present disclosure will infringe the protective scope of the present disclosure provided they are made without departing from the technical scope disclosed by the present disclosure by technical person familiar with skill in the art based on the conception.

What is claimed is:

1. A structure of a spring module group for installing independent springs, wherein:

the spring module group is configured to be assembled to form a spring mattress, the spring module group comprises a connecting base and a plurality of elastic modules assembled on the connecting base, the connecting base comprises a plurality of through holes corresponding to the plurality of elastic modules, the connecting base comprises one or more buckling grooves configured to limit the plurality of elastic modules from being separated from the connecting base, the one or more buckling grooves are configured to be releasably buckled to the plurality of elastic modules, the plurality of elastic modules comprise spring fixing seats and spring sleeves buckled to each other, the spring sleeves are configured to receive tapered springs in the spring sleeves, the spring sleeves have cavities configured for a first spring sleeve of the spring sleeves to be stacked with a second spring sleeve of the spring sleeves, and the spring fixing seats comprise openings corresponding to the cavities to allow the second spring sleeve of the spring sleeves to be stacked on the first spring sleeve of the spring sleeves.

2. A structure of a spring module group for installing independent springs, wherein:

the spring module group is configured to be assembled to form a spring mattress, the spring module group comprises a connecting base and a plurality of elastic modules assembled on the connecting base, the connecting base comprises a plurality of through holes corresponding to the plurality of elastic modules, the connecting base comprises one or more buckling grooves configured to limit the plurality of elastic modules from being separated from the connecting base in a vertical direction, the connecting base comprises one or more sliding inlets, multiple of the plurality of elastic modules axially slide into each of the one or more buckling grooves from a corresponding one of the one or more sliding inlets, the connecting base is disposed with one or more positioning structures corresponding to locations of one or more first elastic modules of the plurality of elastic modules and adjacent to the one or more sliding inlets, and the one or more positioning structures are configured to limit the plurality of elastic modules from sliding out of the one or more sliding inlets.

3. The structure of the spring module group for installing the independent springs according to claim 2, wherein:

the one or more buckling grooves comprises C-shaped buckling grooves, the C-shaped buckling grooves are disposed on two side edges of the connecting base, groove openings of the C-shaped buckling grooves are opposite to each other, and edges of spring fixing seats of the plurality of elastic modules are buckled to the C-shaped buckling grooves to position the plurality of elastic modules.

4. The structure of the spring module group for installing the independent springs according to claim 2, wherein:

a body of the connecting base is inclined to form protruding portions as the one or more positioning structures, the one or more positioning structures are higher than a sliding surface of the connecting base, and fixing seat bodies of spring fixing seats of the plurality of elastic modules are formed with concave portions configured for receiving the protruding portions.

5. The structure of the spring module group for installing the independent springs according to claim 4, wherein:

the protruding portions are configured as elastic sheets with slopes so as to be releasably buckled to the concave portions to position the plurality of elastic modules, and a side of the elastic sheets facing away from the sliding surface of the connecting base comprises pressing portions for pushing the one or more positioning structures out of the concave portions to release the positioning of the plurality of elastic modules.

6. The structure of the spring module group for installing the independent springs according to claim 2, wherein:

the connecting base comprises a first base and a second base, and first sides of first ends of the first base and the second base form a pivoted connection.

7. The structure of the spring module group for installing the independent springs according to claim 6, wherein:

second sides opposite to the pivoted connection on the first ends of the first base and the second base are disposed with first buckling members opposite to each other and configured to be buckled together, side edges of the first base and the second base forming a spliced connection through rotation and second side edges of the first base and the second base separated from each other through the rotation are disposed with second buckling members opposite to each other and configured to be connected together, the connecting base is configured using the pivoted connection such that the first base and the second base are configured to be releasably engaged with each other through the second buckling members on the side edges of the first base and the second base forming the spliced connection, or the connecting base is configured using the pivoted connection such that the first base and the second base are configured to be releasably buckled through the first buckling members on the first ends of the first base and the second base, and the connecting base is configured to be releasably engaged with a second connecting base adjacent to the connecting base through the second buckling members.

8. The structure of the spring module group for installing the independent springs according to claim 6, wherein:

multiple of the one or more sliding inlets for the plurality of elastic modules are disposed on the first ends of the first base and of the second base having the pivoted connection.

9. The structure of the spring module group for installing the independent springs according to claim 2, wherein:

the plurality of elastic modules comprise spring fixing seats and spring sleeves buckled to each other, the spring sleeves are configured to receive tapered springs in the spring sleeves, the spring sleeves have cavities configured for a first spring sleeve of the spring sleeves to be stacked with a second spring sleeve of the spring sleeves, and the spring fixing seats comprise openings corresponding to the cavities to allow the second spring sleeve of the spring sleeves to be stacked on the first spring sleeve of the spring sleeves.

10. The structure of the spring module group for installing the independent springs according to claim 9, wherein:

the plurality of through holes of the connecting base correspond to the openings of the spring fixing seats to enable the spring module group and one or more other spring module groups to be stacked.

11. The structure of the spring module group for installing the independent springs according to claim 9, wherein:

the spring sleeves in the plurality of elastic modules for receiving the tapered springs are plastic spring sleeves or cloth-wrapped spring sleeves.

12. A spring mattress, wherein:

the spring mattress is formed using the structure of the spring module group for installing the independent springs according to claim 2, two sides of an end of the spring module group are oppositely disposed with a rotating buckling member and an engaging member configured to be buckled to each other, and the rotating buckling member of the spring module group is configured to be releasably connected to an engaging member of a second spring module group.

13. A cushion, comprising:

the spring mattress according to claim 12, a flexible cushion layer, and a cloth cover, wherein:

the flexible cushion layer and the cloth cover are disposed on the spring mattress in sequence, the flexible cushion layer comprises a skirt having hanging straps, and the rotating buckling member comprises a hanging lug configured to cooperate with and hang to a corresponding one of the hanging straps to fix the flexible cushion layer.

14. A structure of a spring module group for installing independent springs, wherein:

the spring module group is configured to be assembled to form a spring mattress, the spring module group comprises a connecting base and a plurality of elastic modules assembled on the connecting base, the connecting base comprises a plurality of through holes corresponding to the plurality of elastic modules, the connecting base comprises one or more buckling grooves configured to limit the plurality of elastic modules from being separated from the connecting base, the one or more buckling grooves are configured to be releasably buckled to the plurality of elastic modules, the connecting base comprises a first base and a second base, and first sides of first ends of the first base and the second base form a pivoted connection.

* * * * *